US008506133B2

(12) United States Patent
Tomiyoshi et al.

(10) Patent No.: US 8,506,133 B2
(45) Date of Patent: Aug. 13, 2013

(54) LIGHTING DEVICE

(75) Inventors: Yasushige Tomiyoshi, Osaka (JP); Kenji Takahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/376,366

(22) PCT Filed: Jun. 9, 2010

(86) PCT No.: PCT/JP2010/003831
§ 371 (c)(1),
(2), (4) Date: Dec. 5, 2011

(87) PCT Pub. No.: WO2011/001605
PCT Pub. Date: Jan. 6, 2011

(65) Prior Publication Data

US 2012/0127733 A1 May 24, 2012

(30) Foreign Application Priority Data

Jun. 30, 2009 (JP) ..... 2009-154998

(51) Int. Cl.
*F21V 15/00* (2006.01)

(52) U.S. Cl.
USPC ..... 362/363; 362/256; 362/267

(58) Field of Classification Search
USPC ..... 362/255, 256, 267, 311.01, 311.14, 362/363, 374, 375
See application file for complete search history.

(56) References Cited

U.S. PATENT DOCUMENTS

| | | | | |
|---|---|---|---|---|
| 3,366,787 | A * | 1/1968 | Kelley | 362/311.14 |
| 6,874,905 | B1 * | 4/2005 | Beadle | 362/267 |
| 7,091,582 | B2 * | 8/2006 | Merlin et al. | 362/255 |
| 7,758,223 | B2 * | 7/2010 | Osawa et al. | 362/267 |

FOREIGN PATENT DOCUMENTS

| | | |
|---|---|---|
| JP | 63-029405 | 2/1988 |
| JP | 7192694 | 7/1995 |
| JP | 11345509 | 12/1999 |
| JP | 2008091140 | 4/2008 |

* cited by examiner

*Primary Examiner* — Y My Quach Lee

(57) ABSTRACT

A compact LED lamp (1) is provided with a holder (20), an LED module (10) mounted on the holder (20), and a globe (70) covering the LED module (10). The holder (20) has a groove (21) surrounding the LED module (10) at a top surface (24*a*) of the holder (20), with a rim (70*a*) of the globe (70) inserted in the groove (21). When comparing an edge (D1) and an edge (D2) along a side wall (24*c*) of the groove (21), the edge (D1) is closer to an opening of the groove, and the edge (D2) is closer to a bottom of the groove. The edge (D2) is more recessed than the edge (D1) in a direction perpendicular to a direction of depth of the groove. Furthermore, the groove (21) has through-holes (22) at part of a bottom surface (24*d*) of the groove (21) to connect to a back surface (24*b*) of the holder (20). The groove (21) and the through-holes (22) are filled with adhesive (80).

14 Claims, 11 Drawing Sheets

LIGHTING DEVICE

TECHNICAL FIELD

The present invention relates to an illumination device, in particular to an illumination device provided with a semiconductor light-emitting element such as a Light Emitting Diode (LED).

BACKGROUND ART

In the field of general illumination, the widespread use of conventional incandescent light bulbs is giving way to use of fluorescent lamps, which are energy efficient and have a longer life expectancy. In recent years, demand for even greater energy efficiency and life expectancy has spurred research and development of lamps that use an LED. In particular, development of compact LED lamps, which can be used directly in existing light bulb sockets, is progressing (see, for example, Patent Literature 1). The structure of a compact LED lamp according to conventional technology is described with reference to FIG. 13.

As shown in FIG. 13, in a compact LED lamp, an LED module 910 is mounted on an upper surface 920*a* of a holder 920 and surrounded by a globe 970. An E screw base 940 is attached to the lower section of the holder 920.

A groove 920*b* is formed at the upper surface 920*a* of the holder 920 to surround the LED module 910. A rim 970*b* of the globe 970 is inserted into the groove 920*b*, and a gap between the groove 920*b* and the globe 970 is packed with an adhesive 980. By allowing the adhesive 980 to harden, the holder 920 and the globe 970 bond.

CITATION LIST

Patent Literature

Patent Literature 1: Japanese Patent Application Publication No. 2008-091140

Patent Literature 2: Japanese Patent Application Publication No. 07-192694

SUMMARY OF INVENTION

Technical Problem

However, resin material forming the adhesive deteriorates due to heat. Also, the holder reaches a high temperature due to heat produced by the LED module while the lamp is lit. As a result, the edge of the adhesive in contact with the holder may heat up, deteriorate, and detach from the holder. If the adhesive detaches from the holder, then in particular when the lamp is used in a vertical position (i.e. hanging), the globe may fall out of the holder.

One possible way of addressing this problem is a method to form a concavity in a side wall of the groove (see FIG. 8 of Patent Literature 2) and fill the concavity with the adhesive, so that even if the adhesive detaches from the holder, the adhesive will catch in the concavity so that the globe does not fall out of the holder, for example as in the fluorescent lamp recited in Patent Literature 2.

In this method, however, the weight of the globe is supported only by the part of the adhesive in the concavity. This produces sheer stress between the part of the adhesive in the concavity and the part of the adhesive outside of the concavity that is pulled by the weight of the globe, which may cause a crack to form in the adhesive. If a crack formed in the adhesive extends, the globe may end up falling out of the holder. Moreover, a compact LED lamp is anticipated to have a life expectancy of 20,000 hours or longer. This is far longer than the fluorescent bulb recited in Patent Literature 2, making the problem of the globe falling out of the holder, due to a crack in the adhesive, salient.

In light of the above problems, it is an object of the present invention to provide an illumination device that is better than a conventional configuration at preventing the globe from falling out of the holder.

Solution to Problem

An illumination device according to the present invention comprises: a holder with a top surface and a back surface; a light-emitting module mounted on the top surface of the holder; and a globe covering the light-emitting module, wherein the holder has a groove surrounding the light-emitting module at the top surface of the holder, with a rim of the globe inserted in the groove, along a side wall of the groove, a first location is close to an opening of the groove, a second location is closer to a bottom of the groove than the first location, and the second location is more recessed than the first location in a direction perpendicular to a direction of depth of the groove, and the groove has at least one through-hole at part of the bottom of the groove to connect to the back surface of the holder, the groove and the at least one through-hole being filled with adhesive.

Advantageous Effects of Invention

In the illumination device with the above structure, the adhesive that fills the groove and the through-hole is hardened after having filled the concavity formed on the side wall from the first location to the second location and having passed through the through-hole to the back surface of the holder. For this reason, when a lamp is used in a vertical position, even if the adhesive detaches from the holder, the globe is prevented from falling out of the holder since the adhesive catches on the side wall and the back surface.

Moreover, since the weight of the globe is distributed between the adhesive part that fills the concavity of the side wall and the adhesive part that reaches the back surface, the burden of the weight of the globe on the adhesive part that fills the concavity of the side wall is reduced as compared to when only the adhesive part that fills the concavity of the side wall supports the weight of the globe. Therefore, this structure reduces the occurrence of cracks in the adhesive and prevents the globe from falling out due to cracks in the adhesive.

The illumination device according to the present invention is thus better than a conventional configuration at preventing the globe from falling out.

DESCRIPTION OF EMBODIMENTS

Embodiments of the present invention are described in detail with reference to the drawings.

Embodiment 1

<Overall Structure of Lamp>

Figure 1:
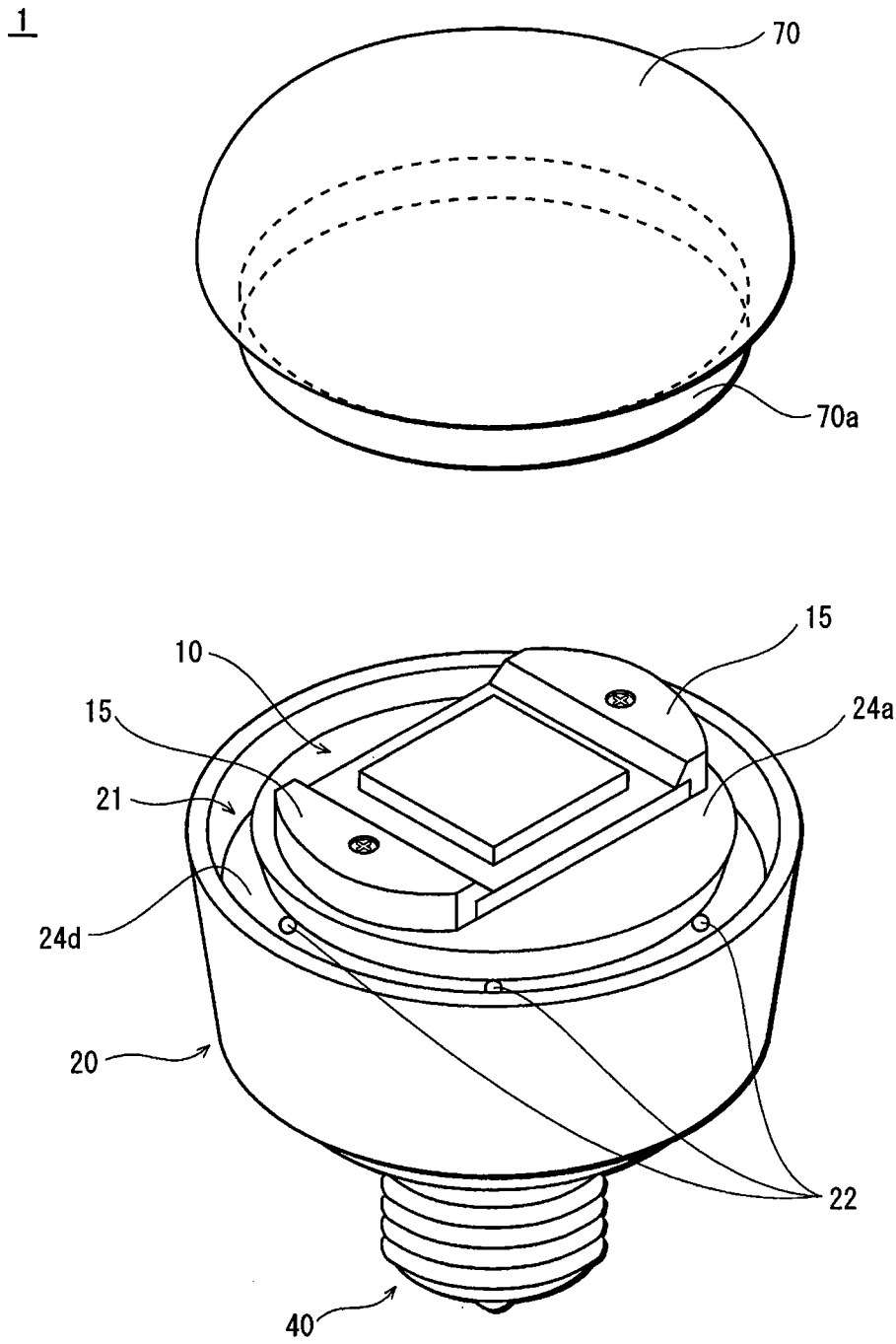
FIG. 1 is an exploded perspective view showing a compact LED lamp according to Embodiment 1 before a globe is attached.

FIG. 1 is an exploded perspective view showing a compact LED lamp 1 according to Embodiment 1 before a globe 70 is attached.

The compact LED lamp 1 is provided with an LED module 10, a holder 20 on which the LED module 10 is mounted, an E screw base 40 attached to the opposite side of the holder 20 than the LED module 10, and a globe 70 covering the LED module 10.

The LED module 10 is fastened to a top surface 24*a* of the holder 20 by a pair of fasteners 15.

An annular groove 21 is formed in the holder 20 so as to surround the LED module 10. A tubular rim 70*a* of the globe 70 is inserted in the groove 21 and attached with adhesive.

In the holder 20, a plurality of through-holes 22 are formed on a bottom surface 24*d* of the groove 21 in a direction of length of the groove 21 at predetermined intervals.

Figure 2:
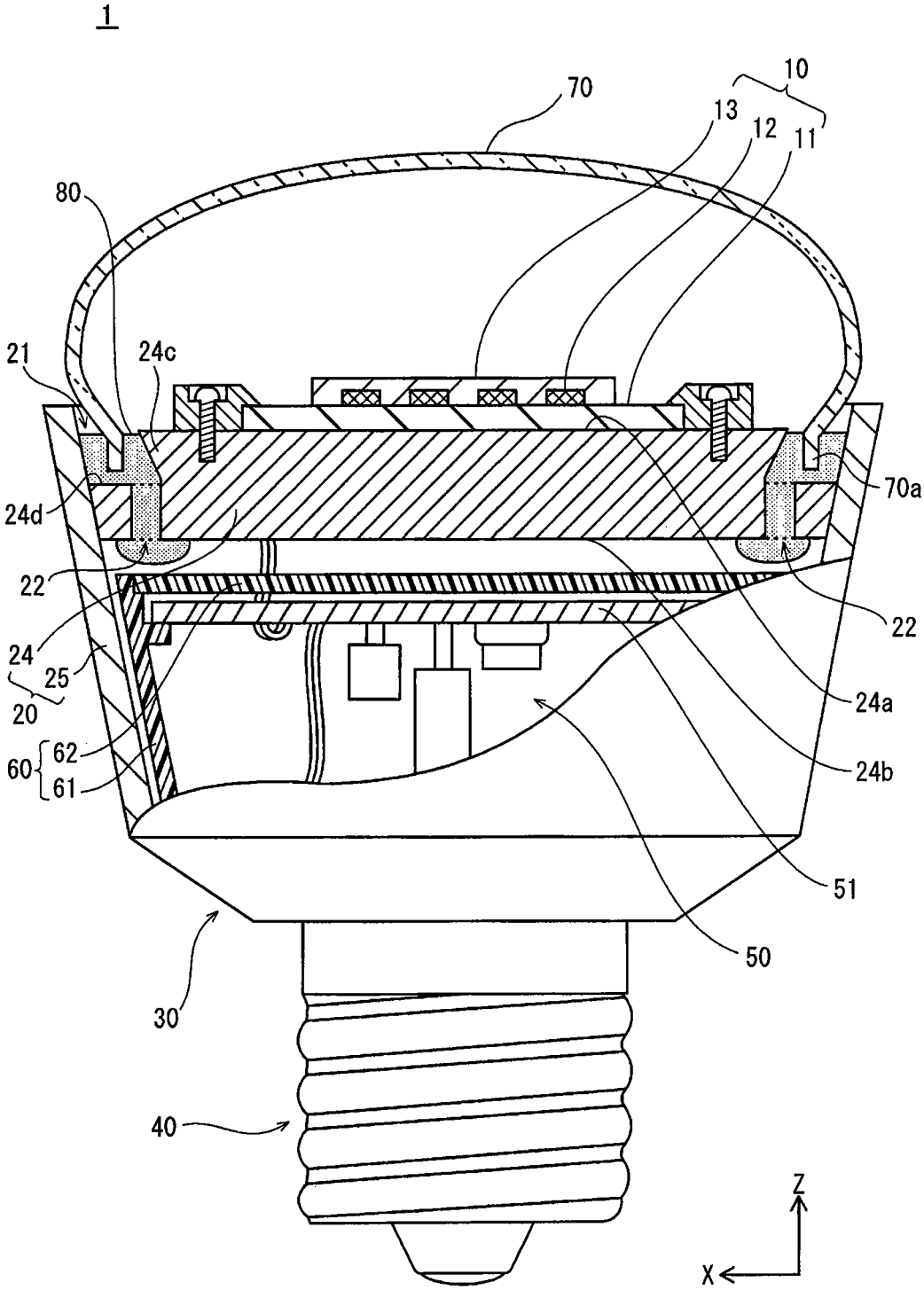
FIG. 2 is a partial cross-section diagram showing the compact LED lamp with the globe attached.

FIG. 2 is a partial cross-section diagram showing the compact LED lamp 1 with the globe 70 attached.

The LED module 10 is formed by a substrate 11, a plurality of LED elements 12 mounted on the substrate 11, and a phosphor layer 13 formed to cover the LED elements 12.

The holder 20 is formed by a tubular portion 25 and a disc-shaped mount 24 inserted in the tubular portion 25.

An annular section along an outer edge of an upper surface, in the direction of the Z-axis, of the mount 24 is cut out. Since the mount 24 is inserted into the tubular portion 25, the cut out section of the mount 24 forms the groove 21. Each through-hole 22 connects the bottom surface 24*d* of this groove 21 to a back surface 24*b* of the mount 24.

The mount 24 and the tubular portion 25 are formed with, for example, a metal such as an aluminum alloy and function as a heatsink for dissipating heat produced by the LED module 10.

A resin case 60 is disposed in the inside of the tubular portion 25, and a lighting circuit 50 for lighting the LED elements 12 is contained in an inner space of the resin case 60.

The resin case 60 provides insulation between the lighting circuit 50 and the mount 24/tubular portion 25. The resin case 60 is composed of a tubular portion 61 and a cap 62 covering an opening of the tubular portion 61. Note that FIG. 2 shows a structure in which a gap exists between the tubular portion 25 of the holder 20 and the resin case 60, but a structure in which no gap exists between the tubular portion of the holder and the resin case is also possible.

The lighting circuit 50 has a lighting circuit substrate 51 and a plurality of electronic components mounted on the lighting circuit substrate 51. The lighting circuit substrate 51 is electrically connected to the LED module 10 and the base 40 by a lead wire.

The globe 70 is composed of, for example, soda glass or heat-resistant transparent resin and allows light emitted from the LED module 10 through to the outside of the lamp. The tubular rim 70*a* of the globe 70 is inserted in the groove 21 and is bonded to the holder 20 by adhesive 80, such as silicone adhesive, that is packed in the groove 21 and allowed to harden.

The base 40 is attached to the tubular portion 25 via a resin coupling member 30.

The coupling member 30 and the resin case 60 are composed of, for example, Poly Buthylene Terephthalete (PBT), Poly Ether Sulfone (PES), Poly Ethylene Terephthalete (PET), etc.

<Bonding Structure of Holder and Globe>

Figure 3:
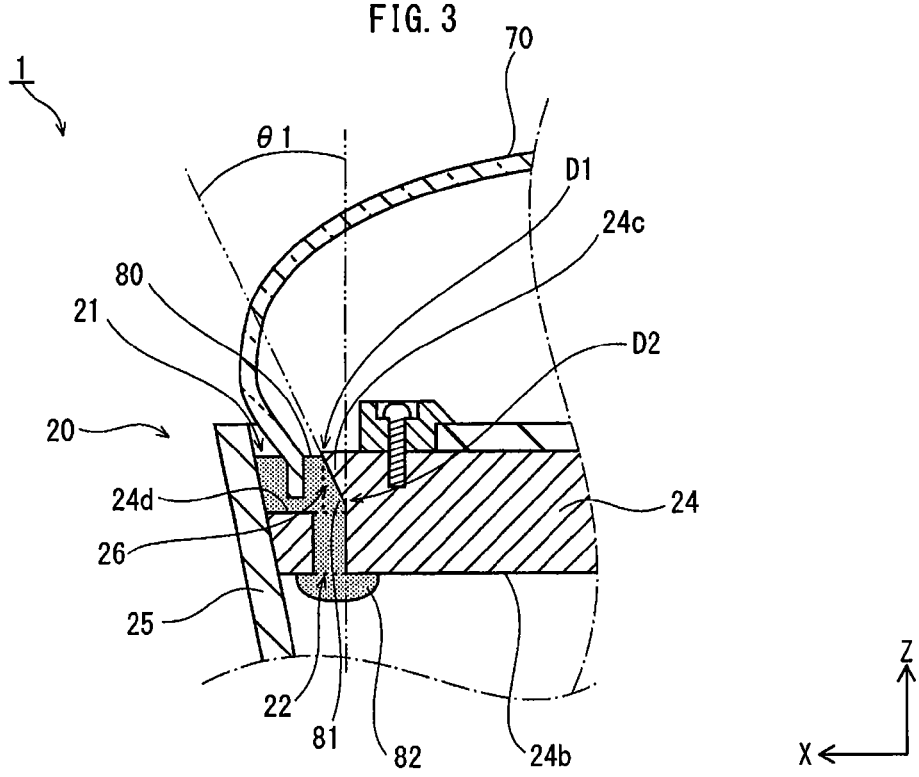
FIG. 3 is a schematic cross-section diagram showing an enlargement of a bonding structure between the holder and the globe.

FIG. 3 is a schematic cross-section diagram showing an enlargement of a bonding structure between the holder 20 and the globe 70.

From an edge D1 (first location) to an edge D2 (second location), a side wall 24*c* of the groove 21 is recessed in an inverted tapered shape, slanting in a direction perpendicular to the depth direction (Z-axis) of the groove 21.

In FIG. 3, an angle of the inverted tapered side wall 24*c* is indicated as θ1 with respect to the Z-axis. This angle θ1 is preferably at least 3° and less than 90°, and more preferably in a range of 5° to 45° inclusive. The side wall 24*c* is formed along the length of the groove 21 at the same angle θ1. The inverted tapered side wall 24*c* is manufactured by, for example, a lathing process, press working, casting, etc.

The groove 21 includes a region 26 between the side wall 24*c* and a line extending vertically from the edge D1 of the side wall 24*c* to the bottom surface 24*d*.

The adhesive 80 fills the region 26 of the groove 21 (adhesive part 81) and has hardened after flowing from the bottom surface 24*d* of the groove 21 through each through-hole 22 to reach the back surface 24*b* (adhesive part 82).

Even if the compact LED lamp 1 with the above structure is used in a vertical position, the globe 70 will not fall out of the holder 20, since the holder 20 and the globe 70 are bonded with the adhesive 80. Furthermore, even if the adhesive 80 deteriorates along the side in contact with the holder 20, which reaches a high temperature due to heat from the LED module 10, the globe 70 is prevented from falling out of the holder 20. This is because the adhesive part 81 catches along the side wall 24*c*, since the side wall 24*c* is an inverted tapered shape, and because the adhesive part 82 catches in an area of the back surface 24*b* surrounding the through-holes 22. The adhesive 80 easily heats up and deteriorates, and the side of the adhesive 80 in contact with the holder 20 deteriorates and detaches more easily than the side in contact with the globe 70. Therefore, this bonding structure is highly effective in preventing the globe from falling out.

Moreover, in the compact LED lamp 1, if the adhesive 80 detaches, the weight of the globe 70 is supported not only by the adhesive part 81 of the adhesive 80, but also by the adhesive part 82. This distributes the burden of supporting the weight of the globe 70 as compared to when the weight is supported only by the adhesive part 81. Accordingly, the burden on the adhesive part 81 for supporting the weight of the globe 70 is reduced, which reduces the occurrence of cracks in the adhesive 80.

Furthermore, in the compact LED lamp 1, since the side wall 24*c* is an inverted tapered shape, the area of the adhesive that catches on the side wall of the groove when the adhesive detaches from the side wall is greater as compared to the concavity in the side wall shown in FIG. 8 of Patent Literature 2. Accordingly, the burden per unit of area on the adhesive part 81 for supporting the weight of the globe 70 is reduced, which reduces the occurrence of cracks in the adhesive 80.

A cross section of the concavity in the side wall shown in FIG. 8 of Patent Literature 2 is rectangular, and when packing the groove with adhesive, it is difficult for the adhesive to fill the corners of the concavity, especially the corner in the ceiling of the concavity, and therefore it is easy for a space to form. By contrast, a cross section of the region 26 of the groove 21 formed on the inverted tapered side wall shown in FIG. 3 is triangular, and there is no corner at the ceiling, which reduces the occurrence of a space. If a space occurs between the groove and the adhesive, then when the lamp is lit, air remaining in the space heats and expands, contracting when the lamp is turned off. Repeated expansion and contraction of the remaining air leads to cracks in the adhesive. In the compact LED lamp 1, when filling with the adhesive 80, air can be removed via the through-holes 22 formed in the bottom surface 24*d*. Therefore, air is better prevented from remaining in the groove 21, which reduces the occurrence of cracks in the adhesive 80.

As described above, the compact LED lamp 1 reduces the occurrence of cracks in the adhesive 80 and is better than a conventional configuration at preventing the globe 70 from falling out of the holder 20.

Furthermore, by providing through-holes 22 in the compact LED lamp 1, the adhesive 80 and the holder 20 bond over an increased area, thus increasing bonding strength.

Embodiment 2

<Overall Structure of Lamp>

Figure 4:
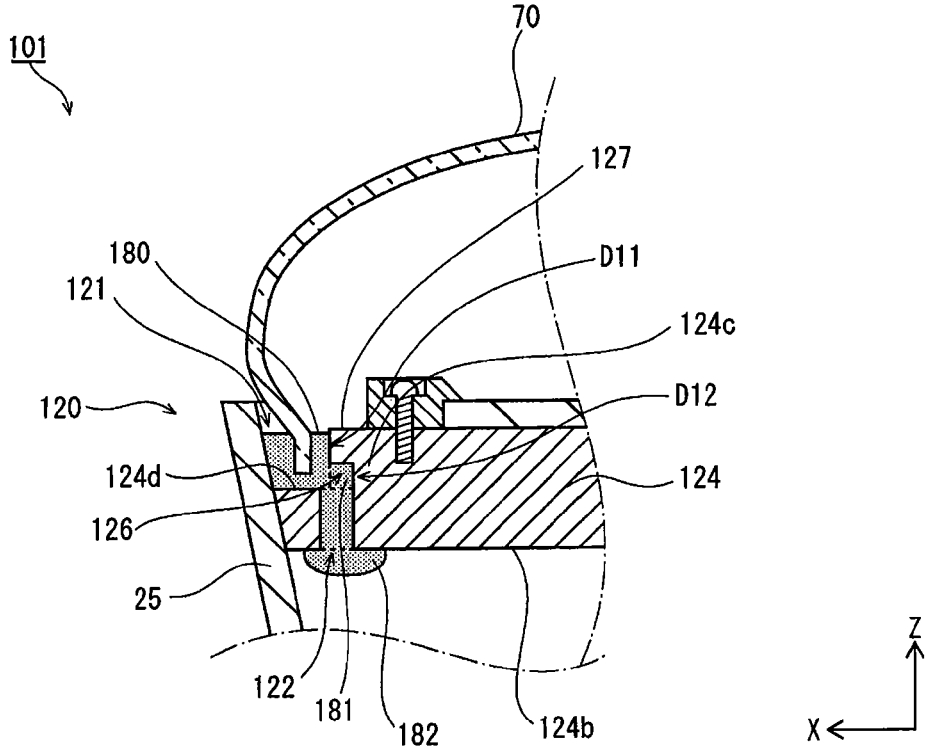
FIG. 4 is a schematic cross-section diagram showing an enlargement of a bonding structure between the holder and the globe in a compact LED lamp according to Embodiment 2.

FIG. 4 is a schematic cross-section diagram showing an enlargement of a bonding structure between a holder 120 and a globe 70 in a compact LED lamp 101 according to Embodiment 2 of the present invention.

As shown in FIG. 4, like the holder 20 in Embodiment 1, the holder 120 has through-holes 122 in Embodiment 2 from a bottom surface 124*d* of the groove 121 to a back surface 124*b*. On the other hand, a side wall 124*c* of the groove 121 in Embodiment 2 has a convexity 127, thus differing from the inverted tapered shape of the side wall 24*c* of the groove 21 in Embodiment 1. Note that for the sake of simplicity, constituent elements that are the same as the compact LED lamp 1 shown in FIGS. 2 and 3 are indicated with the same signs, and an explanation thereof is omitted.

<Bonding Structure of Holder and Globe>

The convexity 127 protrudes out from the side wall 124*c* by the opening of the groove 121 in a direction perpendicular to the depth direction (Z-axis) of the groove 121 and is formed along the entire length of the groove 121. Along the side wall 124*c*, a part D12 (second location) that is closer to the bottom surface 124*d* than the convexity 127 is at a location that is more recessed in a direction perpendicular to the Z-axis than a distal edge D11 (first location) of the convexity 127.

The groove 121 includes a region 126 between the side wall 124*c* and a line extending vertically from the distal edge D11 of the convexity 127 to the bottom surface 124*d*.

The adhesive 180 fills the region 126 of the groove 121 (adhesive part 181) and has hardened after flowing from the bottom surface 124*d* of the groove 121 through each through-hole 122 to reach the back surface 124*b* (adhesive part 182).

When the compact LED lamp 101 with the above structure is used in a vertical position, even if the adhesive 180 deteriorates along the side in contact with the holder 120, the globe 70 is prevented from falling out of the holder 120. This is because the side wall 124*c* includes the convexity 127, on which the adhesive part 181 catches, and also because the adhesive part 182 catches in an area of the back surface 124*b* surrounding the through-holes 122.

Moreover, in the compact LED lamp 101, if the adhesive 180 detaches, the weight of the globe 70 is supported not only by the adhesive part 181, but also by the adhesive part 182. This distributes the burden of supporting the weight of the globe 70. Therefore, this structure reduces the occurrence of cracks in the adhesive 180 and is better than a conventional configuration at preventing the globe 70 from falling out.

Embodiment 3

<Overall Structure of Lamp>

Figure 5:
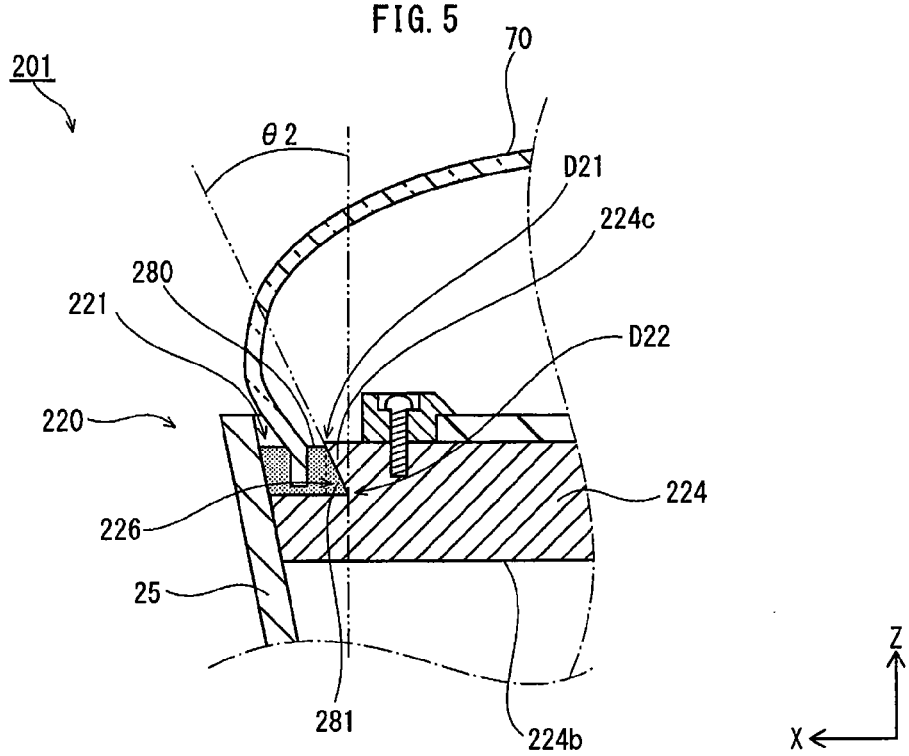
FIG. 5 is a schematic cross-section diagram showing an enlargement of a bonding structure between the holder and the globe in a compact LED lamp according to Embodiment 3.

FIG. 5 is a schematic cross-section diagram showing an enlargement of a bonding structure between a holder 220 and a globe 70 in a compact LED lamp 201 according to Embodiment 3 of the present invention.

As shown in FIG. 5, like the holder 20 in Embodiment 1, a side wall 224*c* of a groove 221 is an inverted tapered shape in the holder 220 in Embodiment 3. On the other hand, whereas through-holes 22 are formed in the holder 20 in Embodiment 1, Embodiment 3 differs in that the holder 220 has no through-holes. Note that for the sake of simplicity, constituent elements that are the same as the compact LED lamp 1 shown in FIGS. 2 and 3 are indicated with the same signs, and an explanation thereof is omitted.

<Bonding Structure of Holder and Globe>

From an edge D21 (first location) to an edge D22 (second location), a side wall 224*c* of the groove 221 is recessed in an inverted tapered shape, slanting in a direction perpendicular to the depth direction (Z-axis) of the groove 221.

The groove 221 includes a region 226 between the side wall 224*c* and a line extending vertically from the edge D21 of the side wall 224*c* to the bottom surface 224*d*.

The adhesive 280 fills the region 226 of the groove 221 (adhesive part 281) and has hardened.

When the compact LED lamp 201 with the above structure is used in a vertical position, even if the adhesive 280 deteriorates along the side in contact with the holder 220, the globe 70 is prevented from falling out of the holder 220. This is because the adhesive part 281 catches along the side wall 224*c*, since the side wall 224*c* is an inverted tapered shape.

Note that if the adhesive 280 in the compact LED lamp 201 detaches, the globe 70 is supported only by the adhesive part 281. However, since the side wall 224*c* is an inverted tapered shape, the burden per unit of area on the adhesive part 281 for supporting the weight of the globe 70 is reduced, and air is prevented from remaining in the groove 221. Therefore, this structure reduces the occurrence of cracks in the adhesive 280 and is better than a conventional configuration at preventing the globe 70 from falling out.

Since there is no need to form through-holes in the compact LED lamp 201, the burden and cost of manufacturing the lamp can be reduced. Whether or not to form through-holes in the holder can be determined in accordance with the specifications and use of the lamp.

Embodiment 4

<Overall Structure of Lamp>

Figure 6:
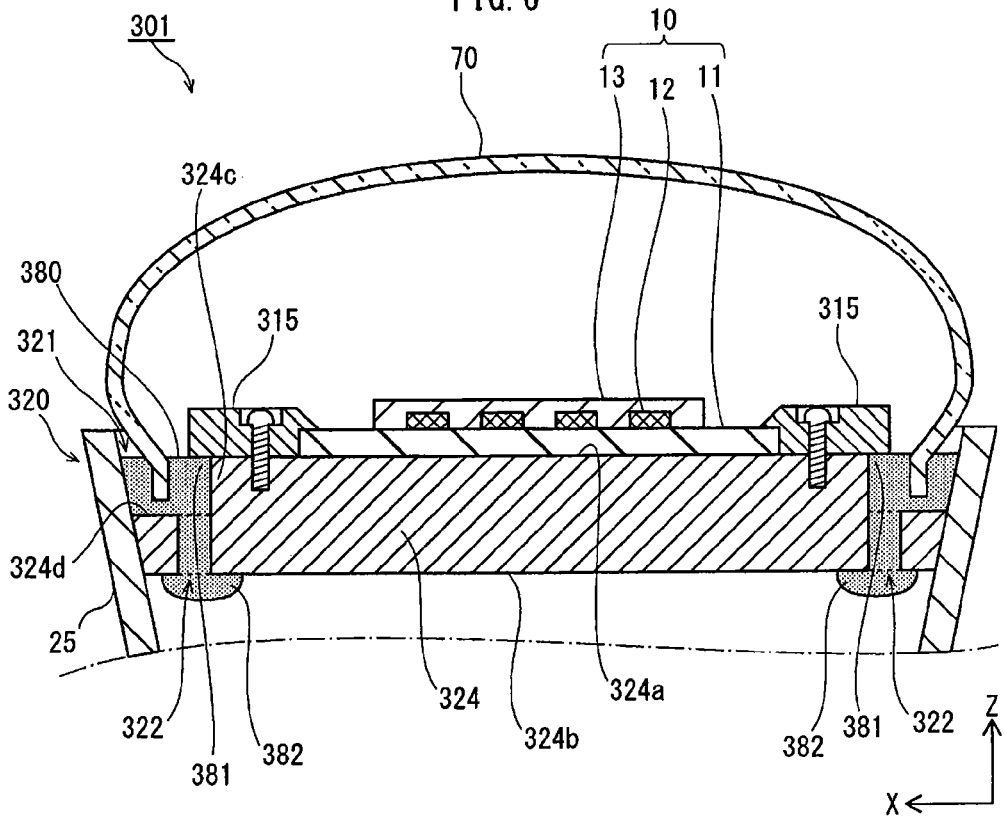
FIG. 6 is a schematic cross-section diagram showing an enlargement of a bonding structure between the holder and the globe in a compact LED lamp according to Embodiment 4.

FIG. 6 is a schematic cross-section diagram showing an enlargement of a bonding structure between a holder 320 and a globe 70 in a compact LED lamp 301 according to Embodiment 4 of the present invention.

As shown in FIG. 6, like the holder 20 in Embodiment 1, through-holes 322 are formed in the holder 320 in Embodiment 4 from a bottom surface 324*d* of the groove 321 to a back surface 324*b*. On the other hand, whereas, a recess is provided in the side wall 24*c* of the groove 21 for the adhesive 80 to catch in the compact LED lamp 1 in Embodiment 1, the compact LED lamp 301 in Embodiment 4 differs in that adhesive 380 catches on fasteners 315 that fasten an LED module 310. Note that for the sake of simplicity, constituent elements that are the same as the compact LED lamp 1 shown in FIGS. 2 and 3 are indicated with the same signs, and an explanation thereof is omitted.

<Bonding Structure of Holder and Fasteners/Globe>

The fasteners 315 are attached so as to partially cover the groove 321 from above, extending beyond a top surface 324*a* of a mount 324.

The adhesive 380 is packed to a position contacting with a back side (lower side along the Z-axis) of the part of the fasteners 315 covering the opening of the groove 321 and has hardened after flowing from the bottom surface 324*d* of the groove 321 through each through-hole 322 to reach the back surface 324*b* (adhesive part 382).

When the compact LED lamp 301 with the above structure is used in a vertical position, even if the adhesive 380 deteriorates along the side in contact with the holder 320, the globe 70 is prevented from falling out of the holder 320. This is because an adhesive part 381, which is covered from above in the direction of the Z axis by the fasteners 315, catches on the fasteners 315, and also because the adhesive part 382 catches in an area of the back surface 324*b* surrounding the through-holes 322.

Moreover, in the compact LED lamp 301, if the adhesive 380 detaches, the weight of the globe 70 is supported not only by the adhesive part 381, but also by the adhesive part 382. This distributes the burden of supporting the weight of the globe 70. Therefore, this structure reduces the occurrence of cracks in the adhesive 380 and is better than a conventional configuration at preventing the globe 70 from falling out.

Since there is no need to process a side wall 324*c* of the groove 321 in the compact LED lamp 301 to form a recess, the burden and cost of manufacturing the holder 320 can be reduced.

Embodiment 5

<Structure of Globe Provided in a Lamp>

Figure 7A:
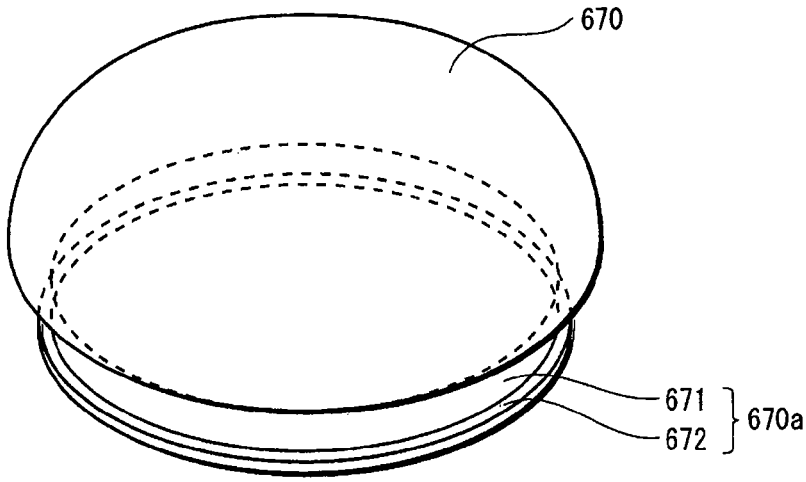
FIGS. 7A and 7B are a schematic cross-section diagram showing an enlargement of a bonding structure between the holder and the globe in a compact LED lamp according to Embodiment 5.
Figure 7B:
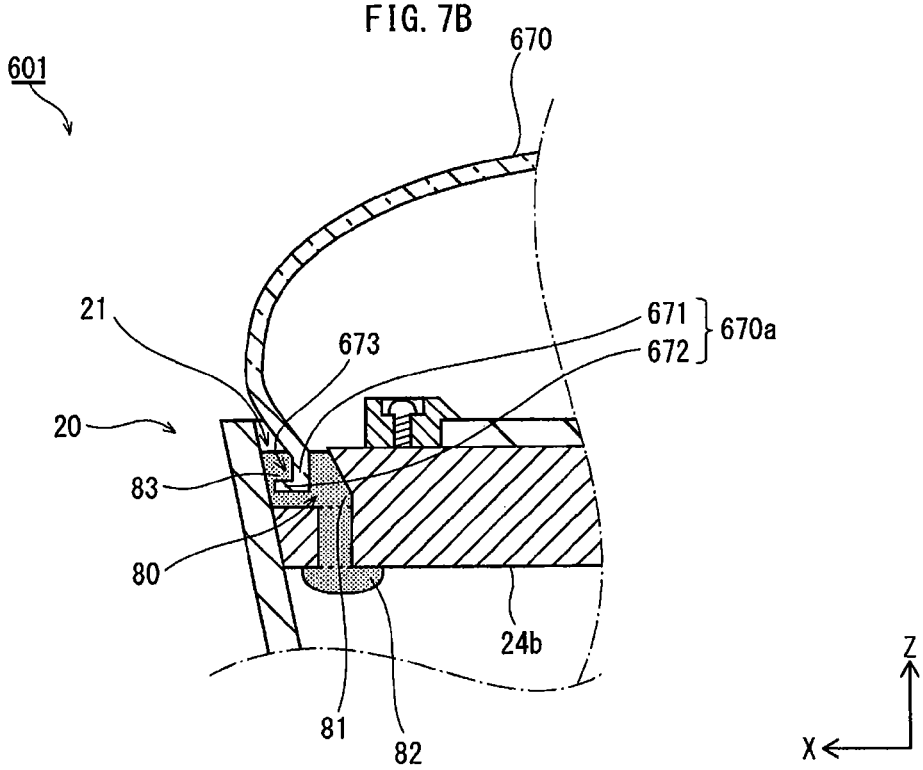

FIG. 7A is a perspective view showing a globe 670 provided in a compact LED lamp according to Embodiment 5 of the present invention, and FIG. 7B is a schematic cross-section diagram showing an enlargement of a bonding structure between the holder 20 and the globe 670 shown in FIG. 7A.

The globe provided in the compact LED lamp in Embodiment 5 differs from Embodiment 1, whereas other structures are essentially the same. Specifically, Embodiment 5 differs from Embodiment 1 in that whereas the rim 70*a* of the globe 70 in Embodiment 1 is formed only by a tubular part, a rim 670*a* of the globe 670 in Embodiment 5 is composed of a tubular part 671 and an annular flange 672 provided on the tubular part 671. Note that for the sake of simplicity, constituent elements that are the same as the compact LED lamp 1 shown in FIGS. 2 and 3 are indicated with the same signs, and an explanation thereof is omitted.

<Bonding Structure of Holder and Globe>

In the compact LED lamp 601 in Embodiment 5, as shown in FIG. 7B, the rim 670*a* of the globe 670 is inserted into the groove 21 of the holder 20. Adhesive 80 is packed in the groove 21 and has hardened after filling a region 673 between the tubular part 671 and flange 672 of the rim 670*a* of the globe 670 (adhesive part 83). Accordingly, the flange 672 is completely enclosed by the adhesive 80 in the groove 21. Note that in this Embodiment as well, the adhesive 80 includes two parts, an adhesive part 81 in the groove 21 in the holder 20 and an adhesive part 82 at the back surface 24*b*.

When the compact LED lamp 601 with the above structure is used in a vertical position, even if the adhesive 80 deteriorates along the side in contact with the holder 20 and detaches, the globe 670 is prevented from falling out of the holder 20. Additionally, even if the adhesive 80 further deteriorates and detaches from the globe 670, the flange 672 of the globe 670 catches on the adhesive part 83, preventing the globe 670 from falling out of the holder 20.

Furthermore, by providing the flange 672, the adhesive 80 and the globe 670 bond over an increased area, thus increasing bonding strength as compared to the globe 70 in Embodiment 1.

Embodiment 6

Figure 8A:
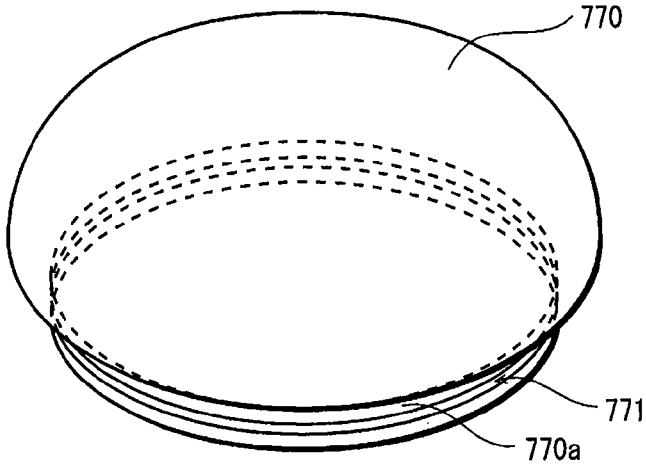
FIGS. 8A and 8B are a schematic cross-section diagram showing an enlargement of a bonding structure between the holder and the globe in a compact LED lamp according to Embodiment 6.
Figure 8B:
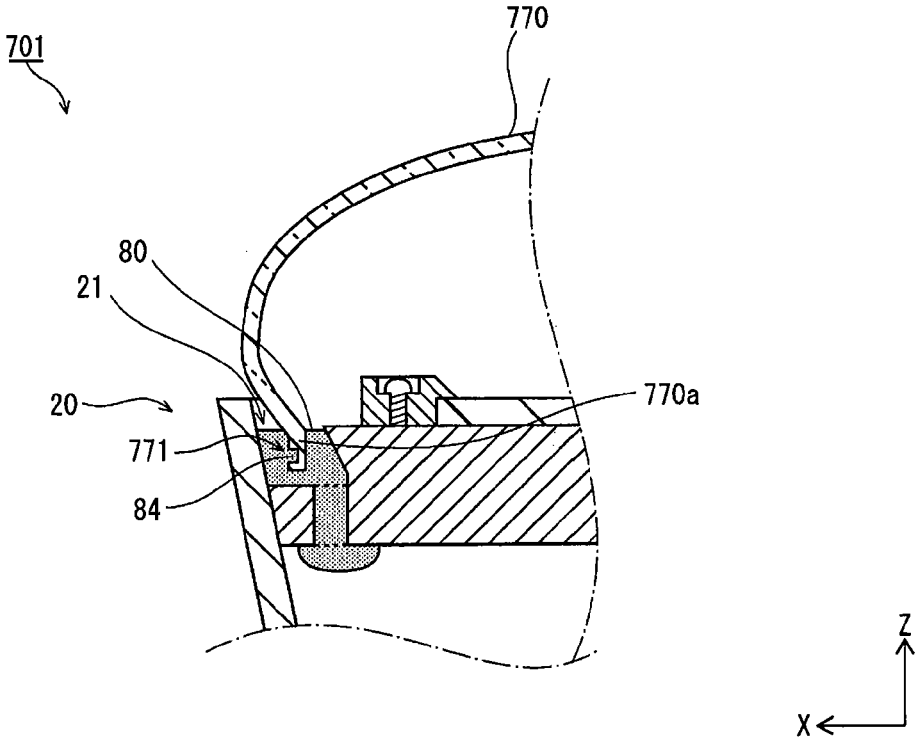

FIG. 8A is a perspective view showing a globe 770 provided in a compact LED lamp according to Embodiment 6 of the present invention, and FIG. 8B is a schematic cross-section diagram showing an enlargement of a bonding structure between the holder 20 and the globe 770 shown in FIG. 8A.

In Embodiment 5, since the flange 672 provided in the rim 670*a* of the globe 670 catches on the adhesive part 83 of the adhesive 80, the globe 670 is prevented from falling out. By contrast, a globe 770 according to Embodiment 6 differs in that an annular concavity 771 is provided along the outer periphery of a rim 770*a*. The concavity 771 is formed to catch on an adhesive part 84 of the adhesive 80 that fills the inside of the concavity 771, thus preventing the globe 770 from falling out. Note that for the sake of simplicity, constituent elements that are the same as the compact LED lamp 601 shown in FIGS. 7A and 7B are indicated with the same signs, and an explanation thereof is omitted.

When the compact LED lamp 701 with the above structure is used in a vertical position, even if the adhesive 80 deteriorates along the side in contact with the holder 20 and detaches, the globe 770 is prevented from falling out of the holder 20. Additionally, even if the adhesive 80 further deteriorates and detaches from the globe 770, the concavity 771 of the globe 770 catches on the adhesive part 84, preventing the globe 770 from falling out of the holder 20.

Furthermore, by providing the concavity 771, the adhesive 80 and the globe 770 bond over an increased area, thus increasing bonding strength, as in Embodiment 5.

Embodiment 7

Figure 9A:
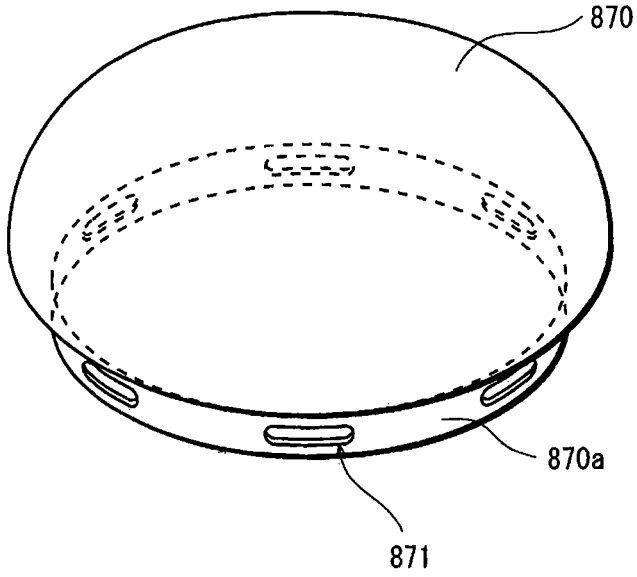
FIGS. 9A and 9B are a schematic cross-section diagram showing an enlargement of a bonding structure between the holder and the globe in a compact LED lamp according to Embodiment 7.
Figure 9B:
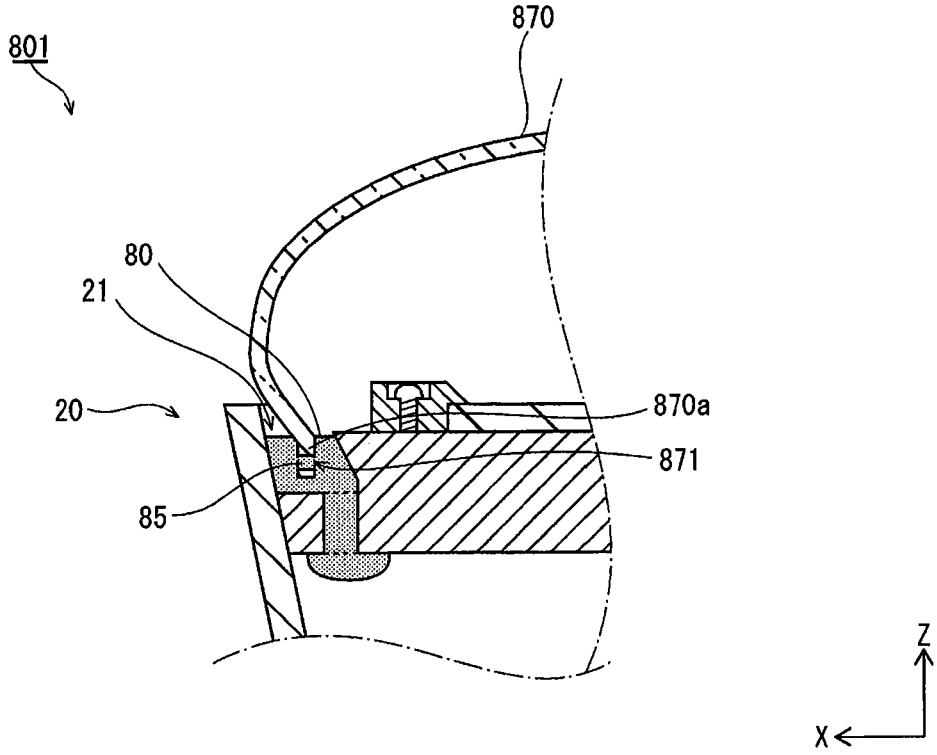

FIG. 9A is a perspective view showing a globe 870 provided in a compact LED lamp according to Embodiment 7 of the present invention, and FIG. 9B is a schematic cross-section diagram showing an enlargement of a bonding structure between the holder 20 and the globe 870 shown in FIG. 9A.

In Embodiment 7, a plurality of oval-shaped through-holes 871 are formed in a rim 870*a* of the globe 870 in a circumferential direction at predetermined intervals, passing through from the inner peripheral surface to the outer peripheral surface of the rim 870*a*. Adhesive parts 85 of the adhesive 80 fill the through-holes 871 and catch on the through-holes 871, preventing the globe 870 from falling out. Embodiment 7 differs from the globe 670 in Embodiment 5 in this respect. Note that for the sake of simplicity, constituent elements that are the same as the compact LED lamp 601 shown in FIGS. 7A and 7B are indicated with the same signs, and an explanation thereof is omitted.

When the compact LED lamp 801 with the above structure is used in a vertical position, even if the adhesive 80 deteriorates along the side in contact with the holder 20 and detaches, the globe 870 is prevented from falling out of the holder 20. Additionally, even if the adhesive 80 further deteriorates and detaches from the globe 870, the through-holes 871 of the globe 870 catch on the adhesive parts 85, preventing the globe 870 from falling out of the holder 20.

Furthermore, by providing the through-holes 871, the adhesive 80 and the globe 870 bond over an increased area, thus increasing bonding strength, as in Embodiment 5.

The compact LED lamp according to the present invention has been described based on the Embodiments, but the present invention is not limited to these Embodiments.

Modifications

For example, the following Modifications are possible. Note that for the sake of simplicity, in the description of the Modifications of the present invention, constituent elements that are the same as the compact LED lamp 1 shown in FIGS. 2 and 3 are indicated with the same signs, and an explanation thereof is omitted.

Figure 10A:
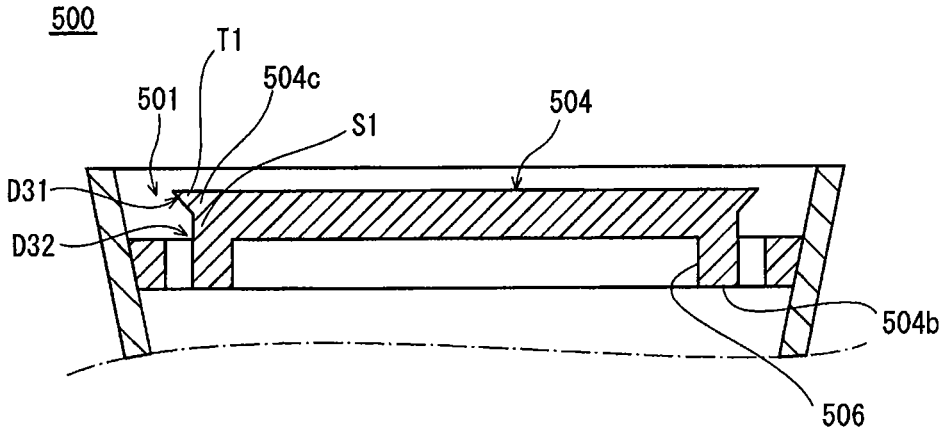
FIGS. 10A and 10B are a schematic cross-section diagram showing a Modification of the holder.
Figure 10B:
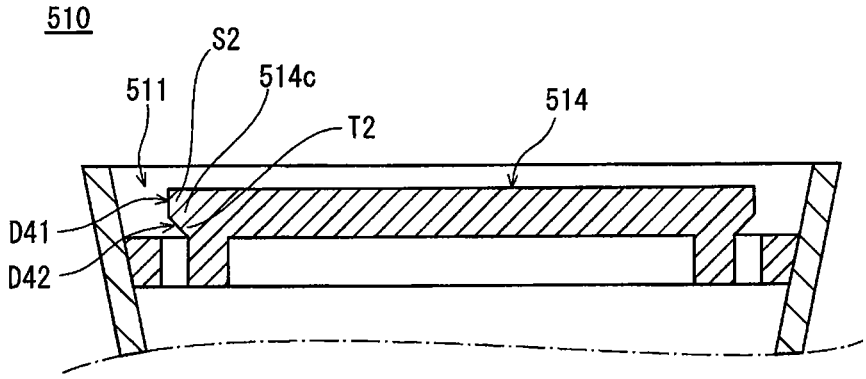

<1> FIGS. 10A and 10B are a schematic cross-section diagram showing a Modification of the holder. This holder differs from the holders in Embodiments 1 through 3 in the shape of the side wall of the groove.

(1) In a direction of depth, part of a side wall 504*c* of the holder 500 shown in FIG. 10A is an inverted tapered shape, composed of a tapered part T1 by the opening and a vertical part S1 by the bottom. The entire length of the side wall in the direction of depth need not be in an inverted tapered shape. As long as a location D32 (second location) close to the bottom of the groove is more recessed than a location D31 (first location) close to the opening of the groove, adhesive filled in a groove 501 catches on the tapered part T1, and the globe is prevented from falling out.

This is advantageous in that, when forming the side wall, it is easier to form only part of the side wall in the direction of depth in an inverted tapered shape, rather than the entire length of the side wall.

Furthermore, as shown in FIG. 10A, a hole 506 that does not pass through a mount 504 can be formed on a back surface 504*b* of the mount 504, thus widening the area inside the holder 500.

(2) In contrast with the side wall 504*c* in FIG. 10A, a side wall 514*c* of a holder 510 shown in FIG. 10B has a vertical part S2 by the opening and a tapered part T2 by the bottom. In the holder 510, a location D42 (second location) close to the bottom of the groove is more recessed than a location D41 (first location) close to the opening of the groove, and therefore adhesive filled in a groove 511 catches on the tapered part T2, and the globe is prevented from falling out.

<2> In the holder according to Embodiments 1 through 3, the recess in the side wall is shown as being formed along the entire length of the groove, but the recess in the side wall may be formed on at least part of the groove in a direction of length, or at predetermined intervals in a direction of length of the groove.

Also, a plurality of recesses in the side wall may be arranged in the direction of depth of the groove. The structure of the side wall of the groove can thus be determined in accordance with the specifications or use of the lamp.

<3> In the holder according to Embodiments 1 through 3, a recess for catching on the adhesive is shown as being formed in the inner peripheral side wall of the groove, but the recess may be formed on the outer peripheral side wall of the groove.

Alternatively, recesses may be formed on both sides of the groove. For example, in the case of a dovetail shaped groove, the adhesive catches on both side walls. As compared to when the adhesive only catches on one side wall, the groove is more effectively prevented from falling out.

Figure 11A:
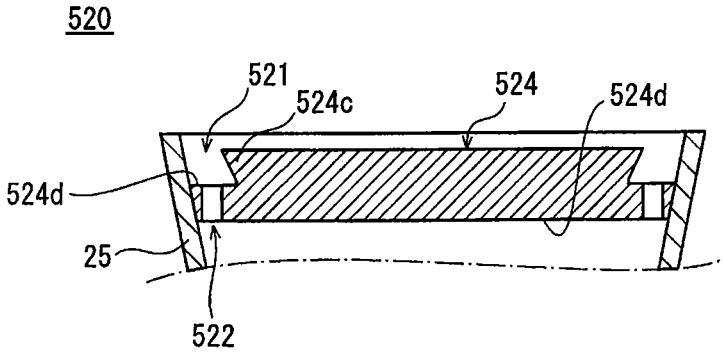
FIGS. 11A and 11B are respectively a schematic cross-section diagram and a schematic plan view showing a Modification of the holder.
Figure 11B:
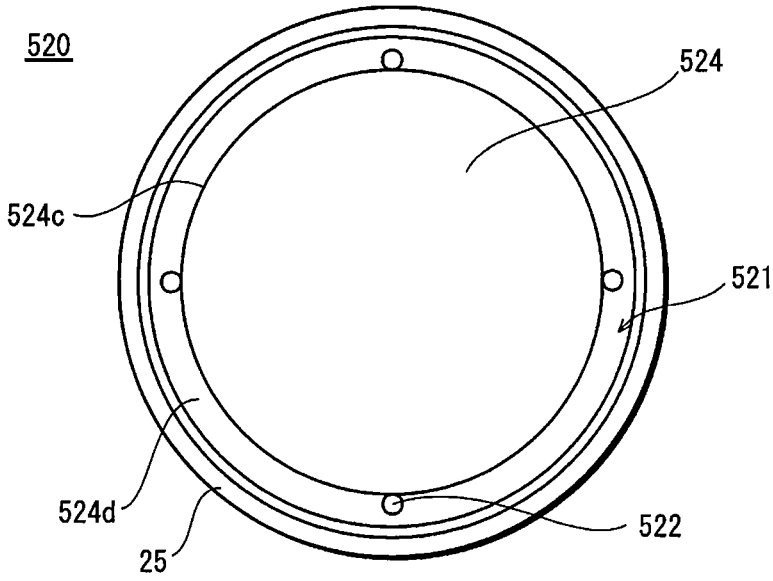
Figure 12A:
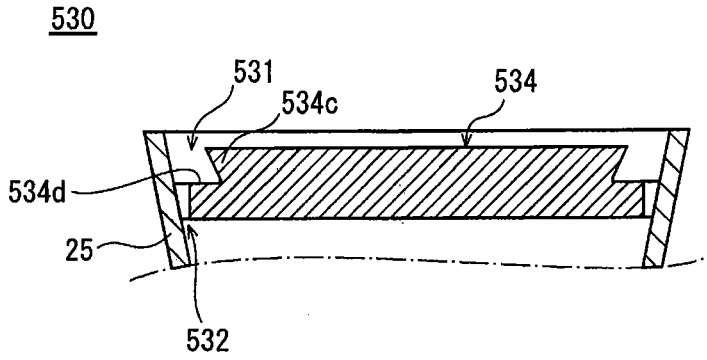
FIGS. 12A and 12B are respectively a schematic cross-section diagram and a schematic plan view showing a Modification of the holder.
Figure 12B:
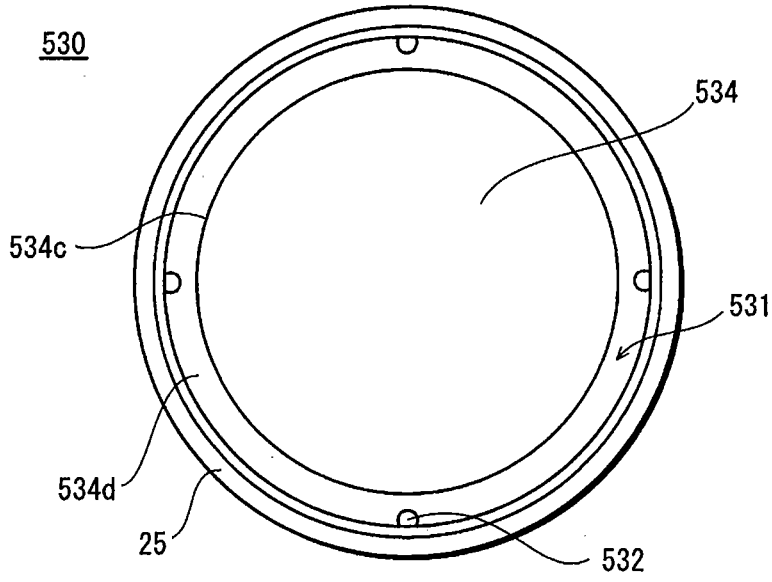
Figure 13:
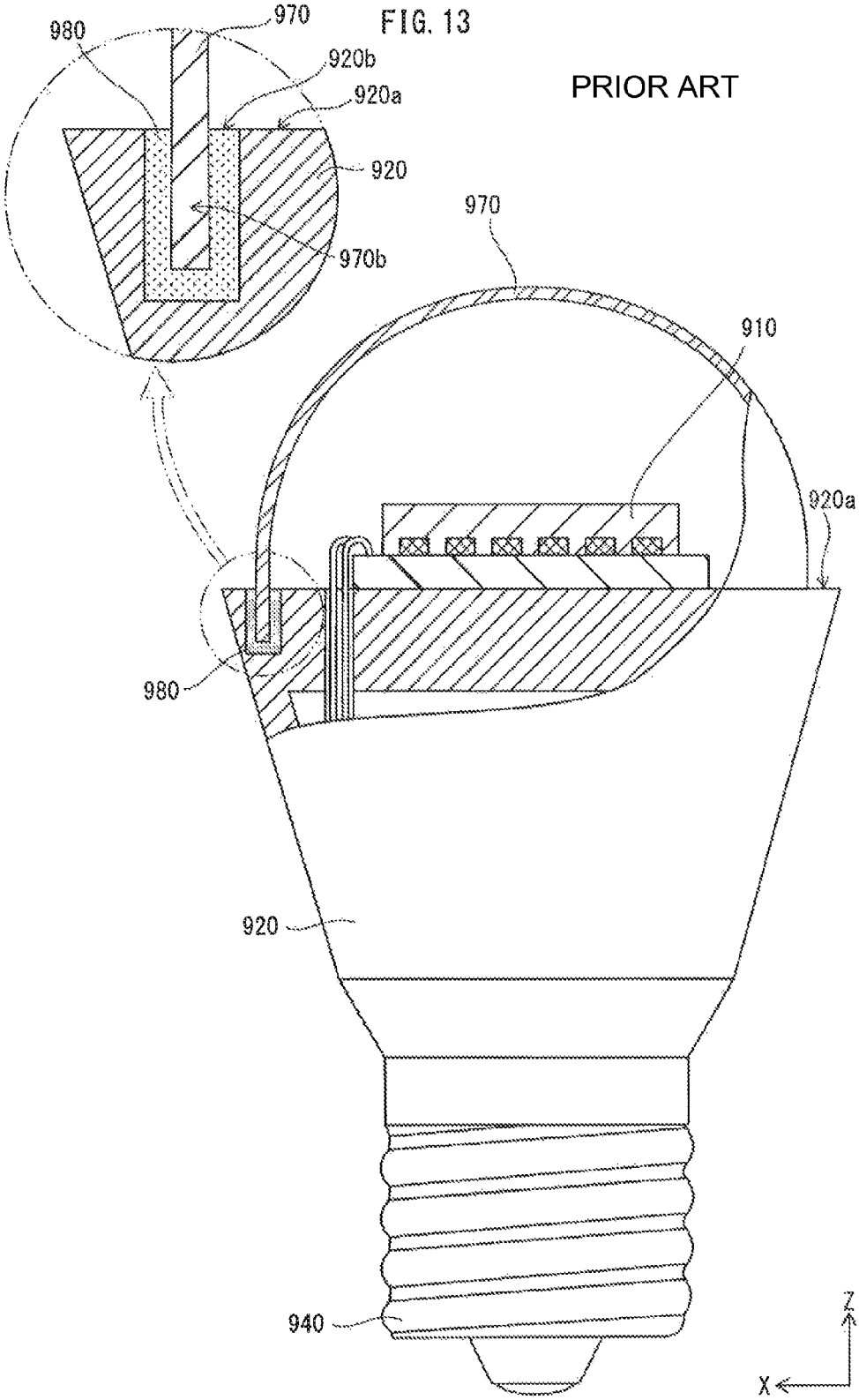
FIG. 13 PRIOR ART
FIG. 13 is a partial cross-section diagram showing a side of a compact LED lamp according to conventional technology.

<4> FIGS. 11A, 11B, 12A, and 12B are Modifications of the holder and differ from the holder according to Embodiment 1 in the arrangement of the through-holes in the groove. Note that FIGS. 11A and 12A are schematic cross-section diagrams, and FIGS. 11B and 12B are schematic plan views.

(1) In a holder 520 shown in FIGS. 11A and 11B, a side wall 524*c* is an inverted tapered shape, and when a groove 521 is viewed in a crosswise direction, through-holes 522 are formed at a central part of a bottom surface 524*d* and so as not to overlap the side walls 524*c*. Accordingly, it is easier to form the through-holes since the side wall 524*c* is not an obstacle, unlike when forming the through-holes at a location overlapping the inner peripheral side wall 524*c*. Furthermore, the burden of the weight of the globe is distributed in the crosswise direction with respect to the adhesive filling the groove 521. This reduces the occurrence of cracks in the adhesive and prevents the globe from falling out.

(2) In a holder 530 shown in FIGS. 12A and 12B, a side wall 534*c* is an inverted tapered shape, and when a groove 531 is viewed in a crosswise direction, through-holes 532 are formed at an outer periphery of a bottom surface 534*d* and so as not to overlap the side walls 534*c*. Accordingly, as in the holder 520 in FIG. 11, the through-holes are easy to form. Furthermore, the burden of the weight of the globe is distributed, the occurrence of cracks in the adhesive is controlled, and the globe is prevented from falling out.

(3) In the Modifications shown in FIGS. 11B and 12B, four through-holes are shown as being formed at equal intervals in a direction of length of the groove, but the number of through-holes need not be four. Furthermore, the through-holes are not limited to a round shape, but may for example be rectangular, arc-shaped, etc. The number, shape, size, arrangement, etc. of the through-holes can be determined in accordance with the specifications and use of the lamp.

<5> In the above Embodiments and Modifications, a structure has been described in which the mount and the tubular portion composing the holder are separate elements, but the mount and the tubular portion may be an integral part of the holder.

Also, a structure is possible in which the mount is composed of a separate first mount and second mount. In this structure, the first mount is attached to the tubular portion, and the second mount, on which the LED module is provided, is attached to a central region of the first mount. By thus structuring the mount with two elements, the groove, side wall, and through-holes can be formed more easily.

<6> The globe in Embodiments 5 through 7 may be formed from soda glass, but from the perspective of ease of processing, it is preferable to form the globe from, for example, heat-resistant transparent resin.

<7> In Embodiments 5 through 7, a structure has been described in which the globe is attached to the holder 20 according to Embodiment 1, but the present invention is not limited in this way. For example, the globe according to Embodiments 5 through 7 may be attached to the holder shown in Embodiments 2 through 4, or the holder shown in the Modifications (see FIGS. 4-6 and 10-12).

<8> In the globe 670 according to Embodiment 5, the annular flange 672 has been described as attached to the rim 670*a*, but the present invention is not limited in this way. For example, the flange need not be annular in shape, and one or more arc-shaped flanges may be provided along the periphery of the rim of the globe.

Furthermore, the flange 672 has been described as protruding in a direction perpendicular to the tubular part 671, but the flange 672 may protrude so as to slant downwards or upwards from the tubular part 671. Additionally, the flange may protrude towards the inside of the globe. The number, shape, size, arrangement, etc. of the flanges can be determined in accordance with the specifications and use of the lamp.

<9> The globe 770 according to Embodiment 6 has been described as being provided with the annular concavity 771, but the present invention is not limited in this way. For example, a concavity may be provided along part of the periphery of the rim of the globe, or a plurality of concavities may be provided at predetermined intervals along the periphery. The concavity may also be formed along the inner periphery of the rim of the globe. The number, shape, size, arrangement, etc. of the concavities can be determined in accordance with the specifications and use of the lamp.

<10> In the globe according to Embodiment 7, the plurality of through-holes 871 are formed at predetermined intervals (equal intervals) along the periphery of the rim 870*a*, but the through-holes are not limited in this way. A plurality of through-holes may be formed at differing intervals along the periphery. Furthermore, the shape of the through-holes is not limited to being rectangular as shown in FIG. 9A, but may be another shape, such as a circle. The number, shape, size, arrangement, etc. of the through-holes can be determined in accordance with the specifications and use of the lamp.

<11> In Embodiment 1, the lighting circuit 50 is contained in the resin case 60, but the lighting circuit 50 need not be contained in the resin case 60. As long as insulation can be provided between the lighting circuit and the holder, the structure of the insulation can be determined in accordance with the specifications and use of the lamp.

For example, when not using a resin case, a mount may be provided along the inner circumference of the tubular portion 25, and the lighting circuit substrate 51 may be attached to this mount with an insulating film made of resin therebetween. Furthermore, by filling the space between the lighting circuit substrate 51 and the mount 24 with resin material and covering the lighting circuit substrate 51 with resin material, the insulation properties between the lighting circuit substrate 51 and the mount 24 can be improved.

INDUSTRIAL APPLICABILITY

The present invention can be widely used in general illumination.

REFERENCE SIGNS LIST

1 compact LED lamp
10 LED module
11 substrate
12 LED element
13 phosphor layer
15 fastener
20 holder
21 groove
22 through-hole
24 mount
24*a* top surface
24*b* back surface
24*c* side wall
24*d* bottom surface
25 tubular portion
25*a* side wall
30 coupling member
40 base
50 lighting circuit
51 lighting circuit substrate
70 globe
70*a* rim
80 adhesive
81, 82 adhesive part
101, 201, 301 compact LED lamp
315 fastener
D1, D11, D21 first location
D2, D12, D22 second location
601, 701, 801 compact LED lamp
670, 770, 870 globe
670*a*, 770*a*, 870*a* rim
672 flange
771 concavity
871 through-hole

The invention claimed is:

1. An illumination device comprising;

a holder with a top surface and a back surface;

a light-emitting module mounted on the top surface of the holder; and a globe covering the light-emitting module, wherein the holder has a groove surrounding the light-emitting module at the top surface of the holder, with a rim of the globe inserted in the groove, along a side wall of the groove, a first location is close to an opening of the groove, a second location is closer to a bottom of the groove than the first location, and the second location is more recessed than the first location in a direction perpendicular to a direction of depth of the groove, and the groove has at least one through-hole at part of the bottom of the groove to connect to the back surface of the holder, the groove and the at least one through-hole being filled with adhesive.

2. The illumination device of claim 1, wherein the side wall is in an inverted tapered shape from the first location to the second location.

3. The illumination device of claim 2, wherein
the side wall is in an inverted tapered shape along an entire length of the groove.

4. The illumination device of claim 2, wherein
parts of the side wall are in an inverted tapered shape at predetermined intervals in a direction of length of the groove.

5. The illumination device of claim 1, wherein
the at least one through-hole comprises a plurality of through-holes at predetermined intervals in a direction of length of the groove.

6. The illumination device of claim 1, wherein
the groove is dovetail shaped.

7. The illumination device of claim 1, wherein
the globe has a flange along the rim, and
with the rim of the globe inserted in the groove in the holder, the adhesive encloses the flange.

8. The illumination device of claim 7, wherein
the flange is annular along a periphery of the rim of the globe.

9. The illumination device of claim 1, wherein
at least one of an inner periphery and an outer periphery of the rim of the globe has a concavity,
with the rim of the globe inserted in the groove in the holder, the adhesive fills the concavity.

10. The illumination device of claim 9, wherein
the concavity is annular along a periphery of the rim of the globe.

11. The illumination device of claim 1, wherein
at least one through-hole connects an inner periphery to an outer periphery of the rim of the globe, and
with the rim of the globe inserted in the groove in the holder, the adhesive fills the at least one through-hole.

12. The illumination device of claim 11, wherein
the at least one through-hole connecting the inner periphery to the outer periphery of the rim of the globe comprises a plurality of through-holes at predetermined intervals.

13. An illumination device comprising:
a holder with a top surface and a back surface;
a light-emitting module mounted on the top surface of the holder; and
a globe covering the light-emitting module, wherein
the holder has a groove surrounding the light-emitting module at the top surface of the holder, with a rim of the globe inserted in the groove,
along one side wall of the groove, a first location is close to an opening of the groove, a second location is closer to a bottom of the groove than the first location, and the second location is more recessed than the first location in a direction that moves away from another side wall of the groove and that is perpendicular to a direction of depth of the groove,
the one side wall recesses in an inverted tapered shape from the first location to the second location,
when the rim of the globe is inserted in the groove, the rim of the globe does not enter a region of the groove where the one side wall recess is located, and
a gap between the one side wall of the groove and the rim of the globe is filled with adhesive.

14. An illumination device comprising:
a holder with a top surface and a back surface;
a light-emitting module mounted on the top surface of the holder; and
a globe covering the light-emitting module, wherein
the holder has a groove surrounding the light-emitting module at the top surface of the holder, with a rim of the globe inserted in the groove,
the light-emitting module is fixed by a fastener, the fastener being attached so as to cover part of an opening of the groove, and
the groove has at least one through-hole at part of the bottom of the groove to connect to the hack surface of the holder, the groove and the at least one through-hole being filled with adhesive.

* * * * *